US008171602B1

(12) United States Patent
Zauhar

(10) Patent No.: US 8,171,602 B1
(45) Date of Patent: May 8, 2012

(54) ATTACHABLE PIPE ACCESSORY

(76) Inventor: Zachary H. Zauhar, Gainesville, FL (US)

( * ) Notice: Subject to any disclaimer, the term of this patent is extended or adjusted under 35 U.S.C. 154(b) by 858 days.

(21) Appl. No.: 12/102,436

(22) Filed: Apr. 14, 2008

Related U.S. Application Data

(60) Provisional application No. 60/923,230, filed on Apr. 13, 2007.

(51) Int. Cl.
*A45F 5/00* (2006.01)

(52) U.S. Cl. ..... 24/3.2; 24/3.7; 224/219; 131/178

(58) Field of Classification Search ..... 24/3.1, 24/3.2, 3.7; 40/316, 665; 224/219–222, 224/267; 131/178, 329
See application file for complete search history.

(56) References Cited

U.S. PATENT DOCUMENTS

| | | | | |
|---|---|---|---|---|
| 4,142,536 | A | 3/1979 | DeCarlo | |
| 5,024,402 | A * | 6/1991 | Hamel | 248/52 |
| 5,752,633 | A * | 5/1998 | Antaki | 224/222 |
| 5,788,479 | A | 8/1998 | Galanos et al. | |
| 5,881,436 | A * | 3/1999 | Lyons | 24/16 R |
| 5,924,136 | A * | 7/1999 | Ogean | 2/159 |
| D443,387 | S | 6/2001 | Torres et al. | |
| 6,430,782 | B1 | 8/2002 | Torres et al. | |
| 6,641,390 | B2 | 11/2003 | Genuise | |
| 6,679,405 | B2 * | 1/2004 | Zalis-Hecker et al. | 224/267 |
| 7,536,756 | B2 * | 5/2009 | McLoughlin et al. | 24/298 |
| 2006/0285404 | A1 * | 12/2006 | Alexander | 365/200 |
| 2007/0034218 | A1 * | 2/2007 | Simon | 131/329 |
| 2008/0217369 | A1 * | 9/2008 | Sloot | 224/222 |

* cited by examiner

*Primary Examiner* — James Brittain

(57) ABSTRACT

A pipe or purse accessory for attachment to and around the barrel of a pipe (or a wrist or ankle) is disclosed having a collar wherein the collar is sized for cooperative engagement with the pipe barrel or wrist/ankle. A strap having a first end is attached to the collar and a pocket is attached to the second end of the strap; a clasp allowing detachable engagement with the strap, in proximity with the collar is also included. The collar may be made of an elastic material for a conformable fit around the pipe. The collar size may be adjustable. The clasp to secure the pocket in proximity to the collar may be magnetic, use hooks and loops, buttons and combinations thereof. A band may be affixed to the strap allowing insertion and engagement with an object, such as a key. A slot may be positioned within the pocket to allow conformable insertion and engagement with an object, such as a key.

12 Claims, 8 Drawing Sheets

ATTACHABLE PIPE ACCESSORY

CROSS REFERENCE TO RELATED APPLICATIONS

Applicant, Zachary H. Zauhar, a United States Citizen residing in Gainesville, Fla., claims priority under 35 U.S.C. §119(e) of provisional U.S. Patent Application Serial No. 60,923,230 filed on Apr. 13, 2007 which is incorporated by reference herein.

FIELD OF THE INVENTION

The present invention relates to an accessory that may be attached to a pipe for smoking The accessory may also be worn around a user's wrist or ankle to provide a small attached purse.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.171 (d)(c)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

DETAILED DESCRIPTION - LISTING OF ELEMENTS

Figure 1:
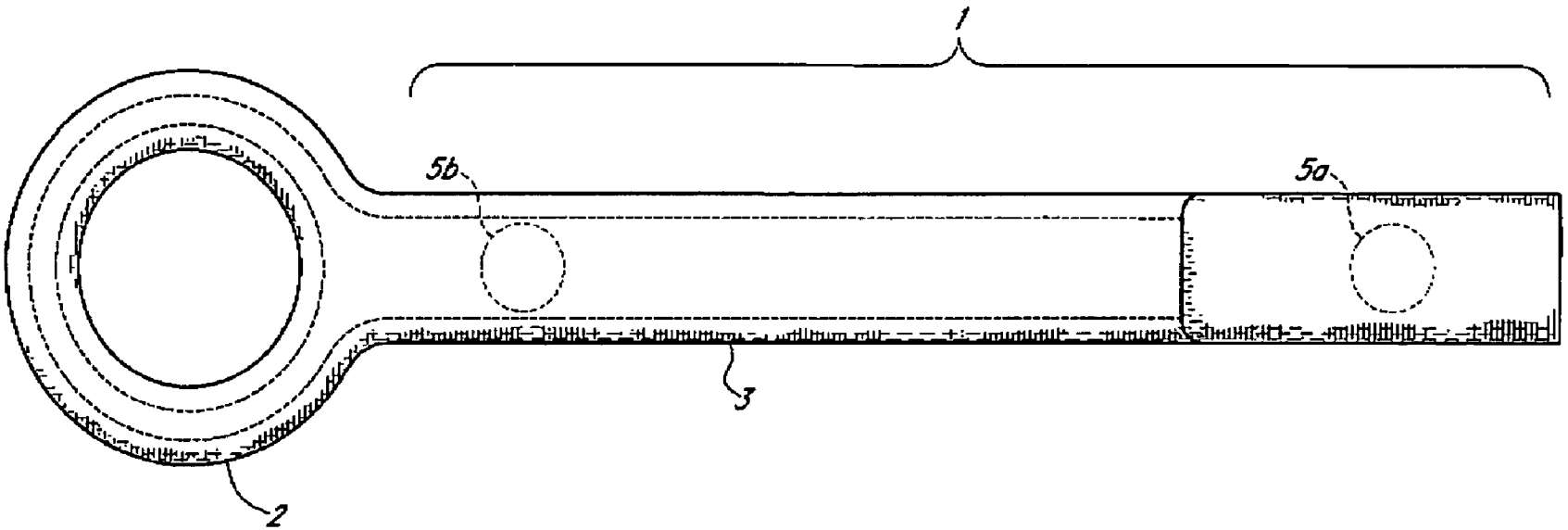
FIG. 1 provides a perspective exterior view of one embodiment of the pipe accessory unit.
Figure 2:
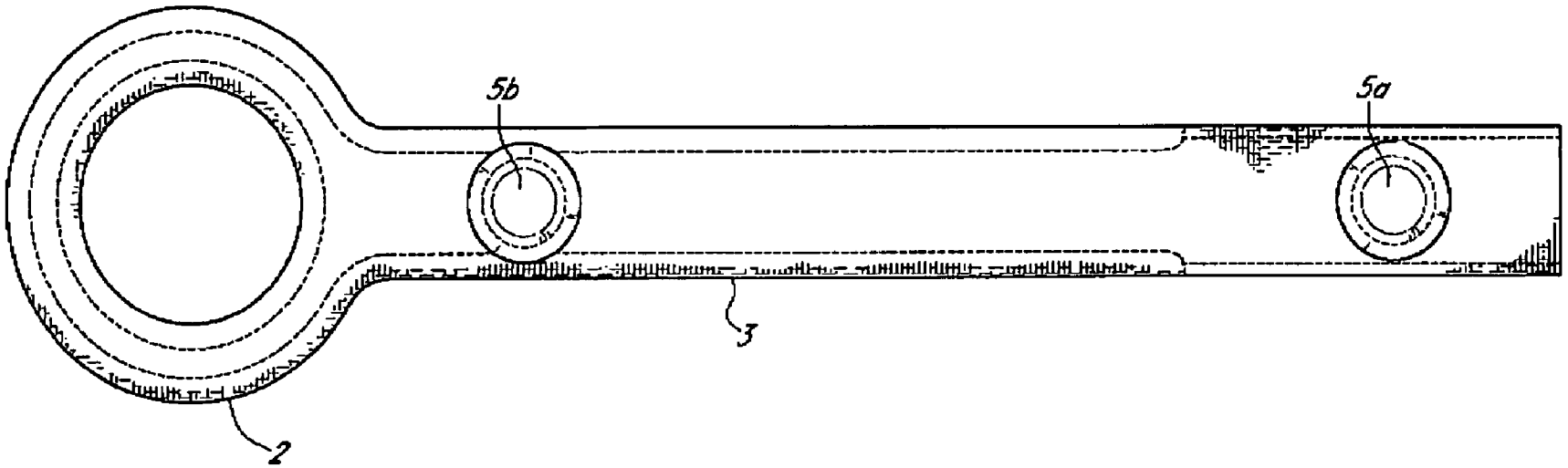
FIG. 2 provides a perspective interior view of one embodiment of the pipe accessory.

| Element Description | Element Number |
|---|---|
| Pipe Accessory | 1 |
| Collar | 2 |
| Strap | 3 |
| Pocket | 4 |
| Clasp | 5 a/b |
| Combustion Chamber Pick | 6 |
| Pipe | 7 |
| Band | 8 |
| Slot | 9 |
| Key | 10 |
| Area | 11 |

Before the various embodiments of the present invention are explained in detail, it is to be understood that the invention is not limited in its application to the details of construction and the arrangements of components and elements set forth in the following description or illustrated in the drawings. The invention is capable of other embodiments and of being practiced or of being carried out in various ways not explicitly disclosed herein without departing from the scope and spirit of the present invention.

DETAILED DESCRIPTION OF INVENTION

Figure 3:
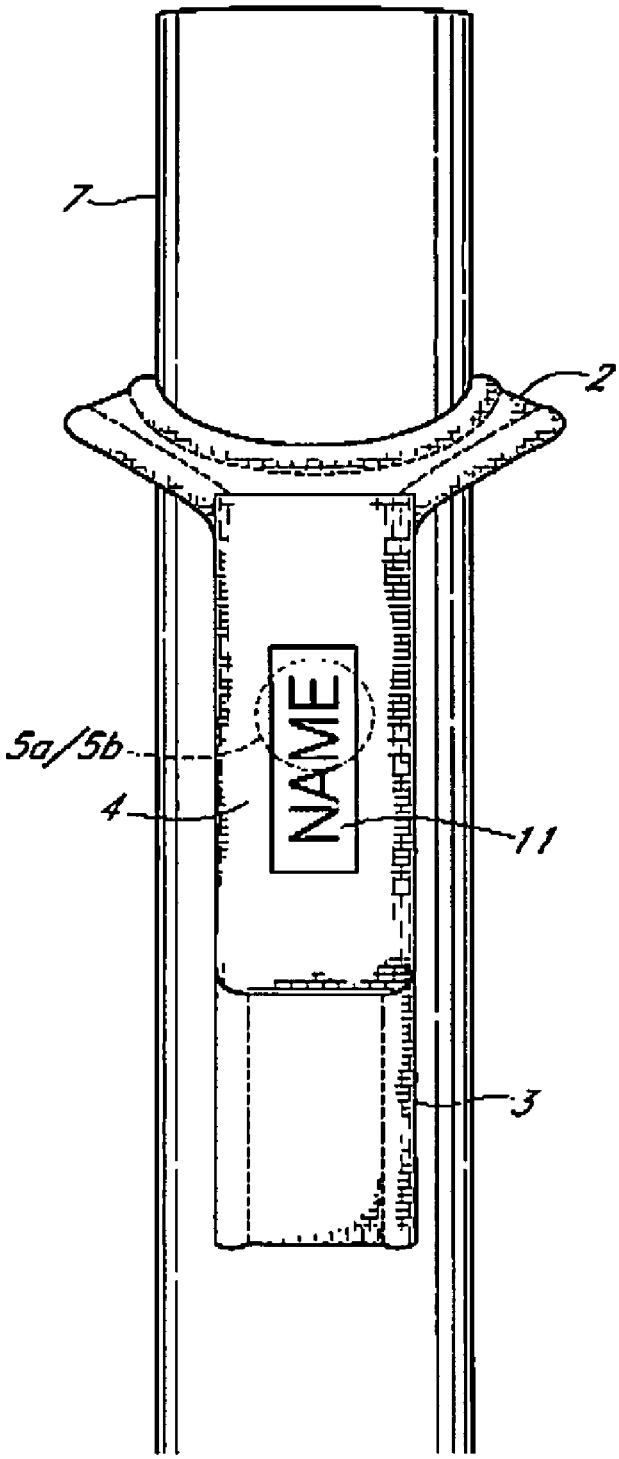
FIG. 3 provides an exterior perspective view of the pipe accessory engaged with a pipe barrel with the clasps cooperably engaged.
Figure 4:
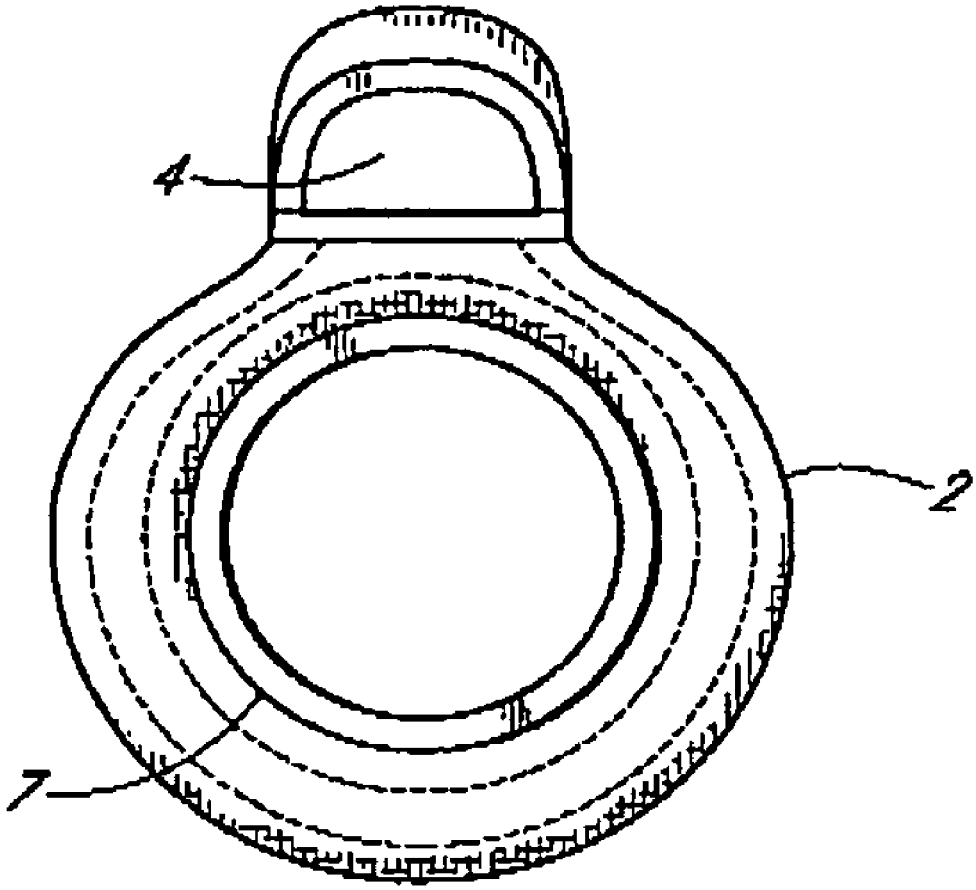
FIG. 4 provides a top view of the pipe accessory of FIG. 3 illustrating the pocket opening in relation to the pipe barrel and the collar.

Referring now to the drawings, wherein like reference numerals designate identical or corresponding parts throughout the several views, FIG. 1 provides a top perspective view of a first embodiment of applicant's pipe accessory unit 1. As illustrated in FIG. 1 the collar 2 of the pipe accessory 1 has a round shape. This shape is one of many shapes that the collar 2 can take. Those skilled in the arts will appreciate other shapes are possible and may be desirable. Although not shown, the collar 2 may be constructed to have two ends which are fastenable and adjustable. As illustrated in FIG. 4, the collar 2 is sized to slide onto and over the barrel of the pipe 7. (See FIG. 3) Those skilled in the arts will appreciate other uses are possible including use as a wrist or ankle bracelet providing a mobile, attached pocket 4. Furthermore, FIG. 3 illustrates the use or attachment of a logo or name to the exterior of pocket 4 (Area 11). A significant number of companies are requesting Applicant manufacture the accessory with the company's logo for synergistic marketing of the company's product during use of Applicant's pipe or purse accessory 1.

For improved fit and conformability, the collar 2 may be made of an elastic material or designed to have elastic like properties for a conformable or "snug" fit around the barrel of the pipe 7. A strap 3 is attached to the collar 2 at one end. The other end of the strap 3 is attached to a pocket 4. As illustrated in the top view of the collar and the pocket), FIG. 4, the pocket 4 does not have a flap. Those in the arts will appreciate this may be added. The pocket 4 as shown may be sized to hold a lighter, as is commonly known to those in the arts. (Not shown) The pocket 4 may also be sized to hold other articles or goods for convenient storage in close proximity to a user's pipe 7 or the user, if worn on the user's wrist or ankle (Not shown). Other articles may include, by way of illustration and without limitation, paper money, coins, rings, watches and auto or house key(s).

The embodiment shown in FIGS. 1-4 has a clasp 5 that is integral with one side of the strap 3 and one side of the pocket 4 which employs magnets. The clasp 5 as shown is labeled 5*a* and 5*b* to illustrate that the clasp 5 is composed of two independent but cooperative portions. As typically used, the clasp 5 allows detachable engagement (illustrated as 5*a*/5*b*) with the strap 3 in proximity to the collar 2. Magnets, hook and loop fasteners (Velcro™ as one example), buttons and combinations therein are other means of detachable fasteners which may be used as a clasp 5, as recited in the claims.

Figure 5:
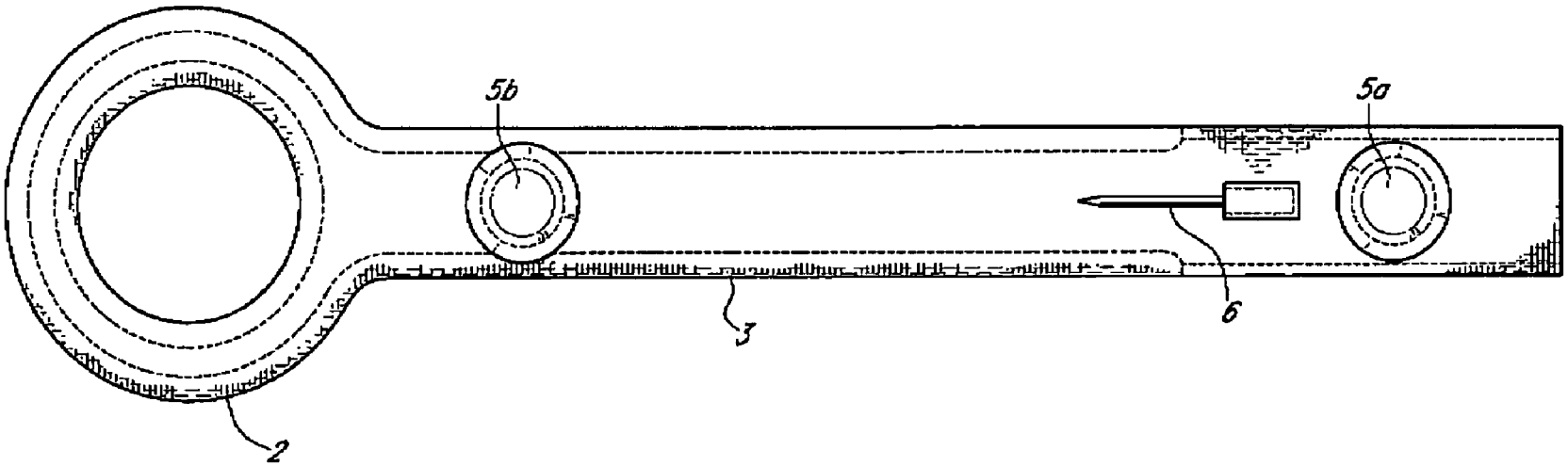
FIG. 5 provides a perspective interior view of another embodiment of the pipe accessory illustrating a combustion chamber pick.
Figure 6:
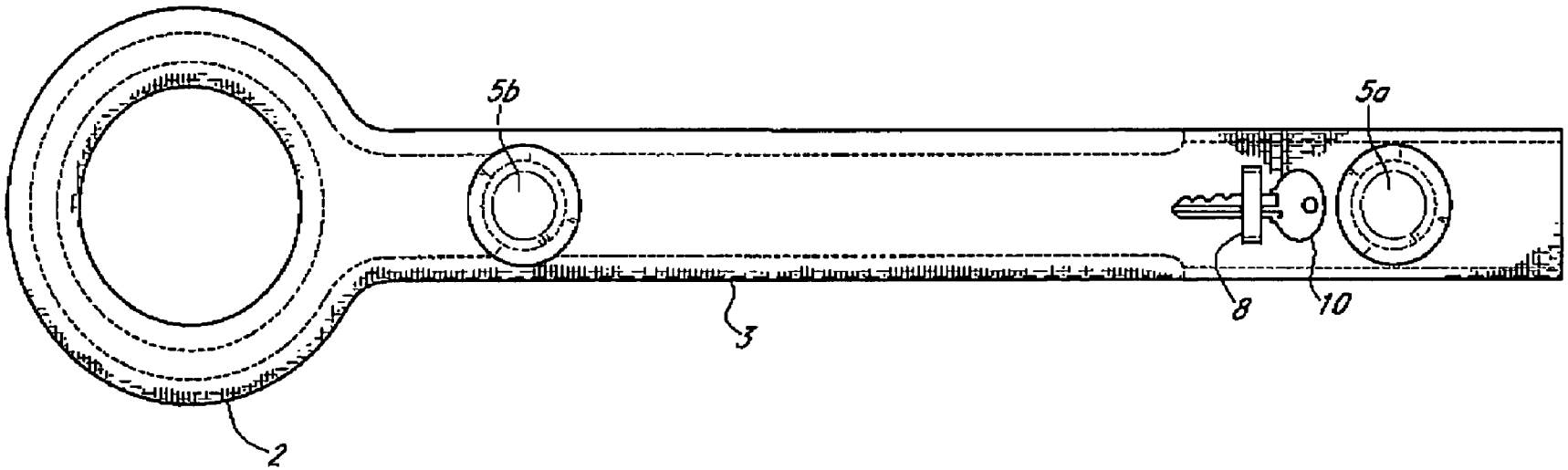
FIG. 6 provides a perspective interior view of another embodiment of the pipe accessory illustrating a combustion chamber pick.
Figure 7:
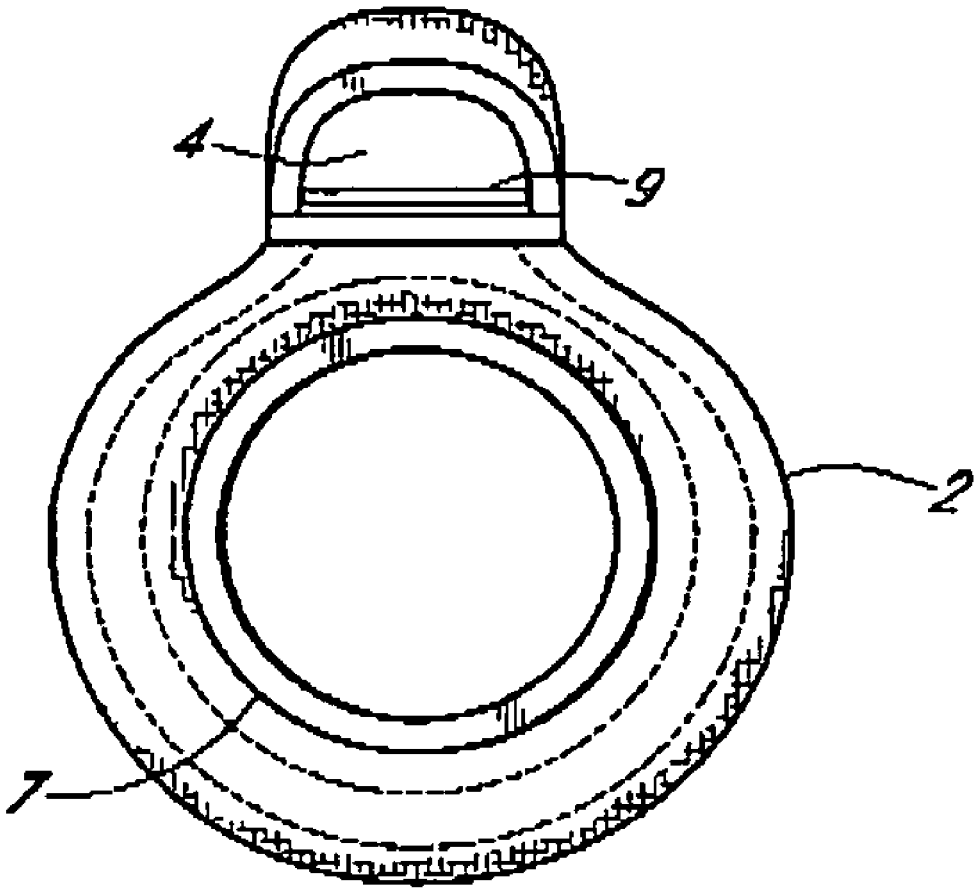
FIG. 7 provides a top view of the pipe accessory illustrating the pocket having a slot opening therein.
Figure 8:
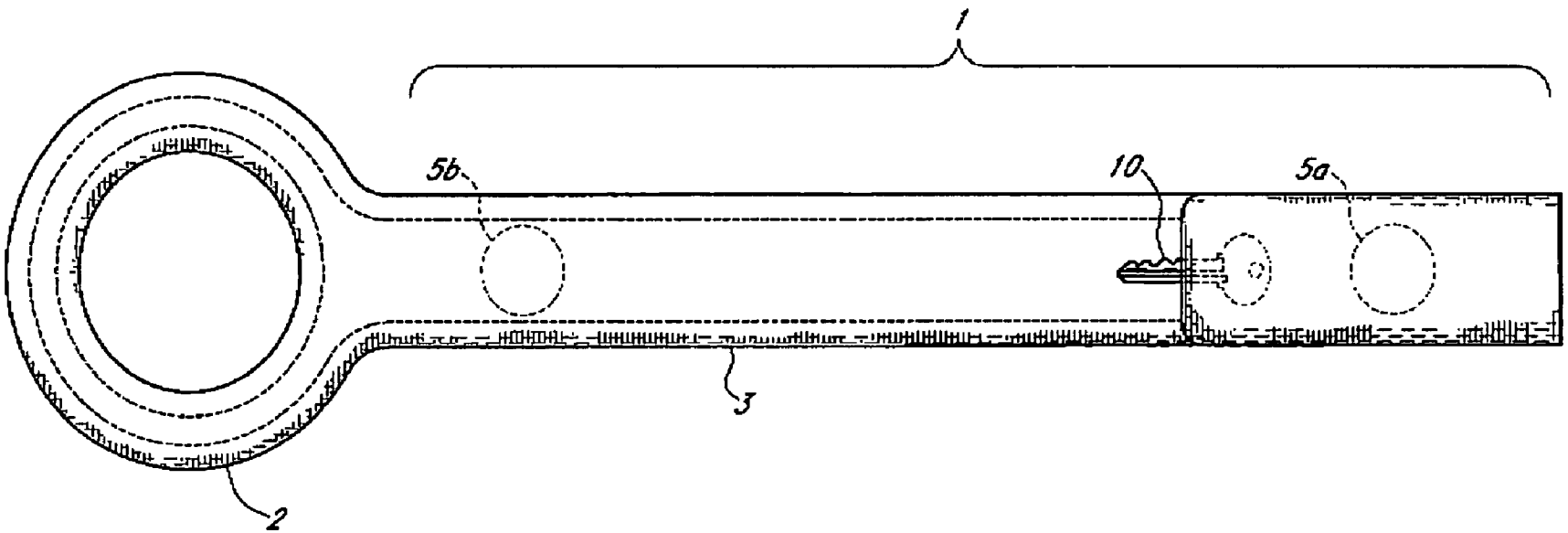
FIG. 8 provides a perspective interior view of the pipe accessory shown in FIG. 7 illustrating a key inserted into the slot opening.

The clasp 5 allows the pocket 4 to be positioned upright during storage (illustrated at FIG. 3) and or detached for deployment during lighting of the pipe 7 or deployment of the combustion chamber pick 6. As shown in FIG. 5, a combustion chamber pick 6 may be positioned on the strap 3 and or integral with the pocket 3 so that the combustion chamber pick 6 is in close proximity to the pocket 4 for engagement with the combustion chamber of the pipe. (Not shown). In other embodiments, illustrated at FIGS. 6 and 7, the combustion chamber pick 6 may be removable from the pocket and or replaced by a band 8 or elastic slot 9. FIG. 6 is a side view illustrating the band 8 placed on the interior side of the strap 3. The band 8 or slot 9 may be sized to allow insertion of a single auto or home key 10. FIG. 7 is a top view of the collar 2 and pocket 4 illustrating an embodiment wherein the slot has been placed in the bottom portion of the pocket 4. FIG. 8 is a side view of FIG. 7 illustrating a key 10 positioned to partially extend out through the slot 9 while remaining partially secluded within pocket 4. Slot 9 should allow adequate expansion upon insertion of the key 10 while still conforming to and holding key 10 within the slot 9. Although not shown, slot 9 may also be placed in strap 2 in combination with band 8 to hold key 10 in place without use of pocket 4.

It should be noted that the present invention is not limited to the specific embodiments pictured and described herein, but is intended to apply to all similar methods and apparatus for securing and attaching a useful and functional pocket to a pipe or a user's wrist or ankle. Accordingly, modifications and alterations from the described embodiments will occur to those skilled in the art without departure from the spirit and scope of the present invention.

What is claimed is:

1. A pipe accessory for attachment to a pipe comprising:

a. A collar, said collar sized for cooperative engagement with a pipe;

b. A strap, said strap having a first end attached to said collar, and having a second end;

c. A pocket, having an opening, said pocket attached to said strap between said first and second ends, said pocket sized for receiving accessories; and;

d. A first clasp affixed to said first end of said strap and a second clasp affixed to said second end of said strap, said first clasp allowing detachable engagement with said second clasp.

2. A pipe accessory according to claim 1 further comprising a combustion chamber pick, said combustion chamber pick in close proximity to said pocket and having a pointed end, said combustion chamber pick sized for engagement with said pipe.

3. A pipe accessory according to claim 1 wherein said collar is of an elastic material for a snug fit around said pipe.

4. A pipe accessory according to claim 1 wherein said pair of clasps are selected from the group consisting of magnets, hook and loop fasteners, and buttons such that said first and second clasps are detachably engaged.

5. A pipe accessory according to claim 1 wherein said pocket has a slot positioned interiorly therein, said slot sized for cooperative engagement with a key.

6. A pipe accessory according to claim 1 wherein said pocket has an area appropriate for insertion of an advertisement, a name or a logo.

7. A purse accessory comprising:

a. A collar, said collar sized for cooperative engagement with a human wrist or a human ankle;

b. A strap, said strap having a first end attached to said collar, and having a second end;

c. A pocket having an opening, said pocket attached to said strap between said first and second ends, said pocket sized for receiving accessories; and, d. A first clasp affixed to one side of said pocket and positioned proximate said second end of said strap, said first clasp allowing detachable engagement with a second clasp affixed to one side of said strap proximate said collar, wherein said pocket is positioned generally adjacent said strap first end and said pocket opening faces said collar when said first clasp is engaged with said second clasp.

8. A purse accessory according to claim 7 further comprising a combustion chamber pick, said combustion chamber pick in close proximity to said pocket and having a pointed end, said combustion chamber pick sized for engagement with a pipe.

9. A purse accessory according to claim 7 wherein said collar is of an elastic material for a conformable fit around said user wrist or said user ankle.

10. A purse accessory according to claim 7 wherein said pair of clasps are selected from the group consisting of magnets, hook and loop fasteners, and buttons such that said first and second clasps are detachably engaged.

11. A purse accessory according to claim 7 wherein said pocket has a slot positioned interiorly therein, said slot appropriately sized for cooperative engagement with an object.

12. A purse accessory according to claim 7 wherein said pocket has an area appropriate for insertion of an advertisement, a name or a logo.

* * * * *